US008182655B2

(12) United States Patent
Zielke

(10) Patent No.: US 8,182,655 B2
(45) **Date of Patent: *May 22, 2012**

(54) PLATING SYSTEMS AND METHODS

(75) Inventor: Darrell W. Zielke, Bothell, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 856 days.

This patent is subject to a terminal disclaimer.

(21) Appl. No.: 12/204,107

(22) Filed: Sep. 4, 2008

(65) Prior Publication Data

US 2009/0057158 A1 Mar. 5, 2009

Related U.S. Application Data

(60) Provisional application No. 60/970,198, filed on Sep. 5, 2007.

(51) Int. Cl.
*C25D 17/00* (2006.01)

(52) U.S. Cl. ..... 204/206

(58) Field of Classification Search ..... 204/206; 205/129, 130

See application file for complete search history.

(56) References Cited

U.S. PATENT DOCUMENTS

| | | | | | |
|---|---|---|---|---|---|
| 2,341,158 | A * | 2/1944 | Nachtman | 226/23 |
| 3,483,113 | A * | 12/1969 | Carter | 204/206 |
| 3,855,108 | A * | 12/1974 | Bolz et al. | 204/206 |
| 4,405,432 | A * | 9/1983 | Kosowsky | 204/206 |
| 4,409,924 | A | 10/1983 | Laverty et al. | |
| 4,529,486 | A | 7/1985 | Polan | |
| 4,921,583 | A | 5/1990 | Sewell et al. | |
| 5,188,720 | A | 2/1993 | Colin et al. | |
| 5,242,562 | A | 9/1993 | Beyerle et al. | |
| 5,372,699 | A | 12/1994 | Rischke et al. | |
| 6,123,473 | A * | 9/2000 | Guillen et al. | 400/335 |
| 7,655,117 | B2 * | 2/2010 | Zielke | 204/206 |
| 2003/0188965 | A1 * | 10/2003 | King et al. | 204/198 |
| 2006/0226017 | A1 | 10/2006 | Zielke | |
| 2007/0045786 | A1 | 3/2007 | Zielke | |
| 2008/0188163 | A1 * | 8/2008 | Duong | 451/36 |

FOREIGN PATENT DOCUMENTS

JP 2003183878 A * 7/2003

* cited by examiner

*Primary Examiner* — Luan Van
(74) *Attorney, Agent, or Firm* — Graybeal Jackson, LLP

(57) ABSTRACT

Embodiments of the invention relate to plating systems configured to strip plate a selected portion of a workpiece (e.g., a lead frame) and methods of plating. In one embodiment, a plating system is configured to plate a selected portion of a workpiece and at least partially compensate for wheel run out. As an alternative, or in addition, to the plating system being configured to at least partially compensate for wheel run out, in another embodiment, a plating system is configured to plate the selected portion of the workpiece and provide for controllably adjusting plating dimensions on the selected portion to be plated.

37 Claims, 14 Drawing Sheets

PLATING SYSTEMS AND METHODS

CLAIM OF PRIORITY

This application claims the benefit of U.S. Provisional Application No. 60/970,198 filed on 5 Sep. 2007, which is incorporated herein, in its entirety, by this reference.

BACKGROUND

Conventional techniques for electroplating metals onto selected portions of parts has typically been performed using step-and-repeat plating for plating selective locations or a generally faster continuous strip plating process for plating portions of parts whose intended plating areas can be arranged in an uninterrupted path. Such parts can be joined together as a lead frame that is a long continuous strip containing duplicate copies of a particular part. The lead frame can be fed through machines that perform various processes on each of the parts of the lead frame in an orderly stepwise manner.

With conventional step-and-repeat plating, a precise mask is positioned over a section of a lead frame having a series of parts. The mask can have one or more openings formed therein so that portions of the part to be plated are exposed through the one or more openings. The unmasked portions of the parts of the masked lead frame section can be exposed to a plating solution and plated with metal.

The lead frame can be negatively charged to plate the exposed areas of the lead frame when they receive plating solution such as by pouring, spraying, or brushing the plating solution from a positively charged applicator, such as a nozzle. After the unmasked portions of the parts of the masked lead frame section have been plated, a new section of the lead frame is moved to be masked and to further repeat the step-and-repeat process. Although the step-and-repeat process can be used for precision plating so that relatively little plating material is wasted, the process can be inherently slow, labor intensive, and costly.

With a conventional continuous plating system, the lead frames can be run at a constant velocity through the plating system to potentially reduce labor requirements and potentially increase throughput. The lead frame is directed into a plating tank while the parts to be plated are trapped between moving masking belts. A masking belt set defines a strip opening that exposes a selected portion of each part of the lead frame therethrough to a plating solution and a backing masking belt covers other portions of each part to prevent those portions from being plated. After plating, a re-reeler can spool the plated parts onto a reel as the parts emerge from the plating tank.

Although conventional continuous plating systems can have relatively faster throughput than the conventional step-and-repeat plating systems, they tend to be more wasteful of the plating materials. In conventional continuous plating systems, the masking belt set can shift back and forth in position orthogonal to its direction of motion, also referred to as trans-linear motion, due to tracking issues with the masking belt set and associated pulleys (e.g., pulley misalignment) and undesired lateral motion of the wheel that drives the motion of the masking belt set. This trans-linear motion can cause a shift back and forth in position of the opening in the masking belt set relative to its associated lead frame part to be masked. Consequently, if the opening was only as large as its corresponding desired portion of the part to be plated, this desired portion of the part may not be fully plated. Through the trans-linear shifting, the opening may not be properly positioned over the part at the time of plating. Rather, the opening may be slightly out of position and if the opening was only the size of the desired portion of the part to be plated, not all of the desired portion of the part would be exposed through the opening to receive the plating solution.

To compensate for this shifting due to the trans-linear motion, the opening may be enlarged enough so that no matter where an opening is in its back and forth trans-linear motion, the entire desired portion of the part to be plated is still exposed through the opening to receive the plating solution. However, since the opening in the masking belt set is larger than the desired portion of the part to be plated, areas of the part that do not require plating will be over-plated, which wastes the expensive plating metal such as gold.

Some conventional continuous plating systems employ masking belts of relatively greater thickness to possibly reduce the amount of trans-linear motion. However, increased masking belt thickness can inhibit the thickness of the plating near the edge of the opening and is often referred to as the "wall effect." The plating material on a plated portion of a part exhibits a non-uniform thickness, with the thickness being thinner near the edges of the plated portion and being thicker near the center of the plated portion. Resultant uneven plating can also waste plating material because more plating material may need to be used in a center of a plated portion in order to have a sufficient amount of plating material near the edges of the plated portion.

SUMMARY

Embodiments of the invention relate to plating systems configured to strip plate a selected portion of a workpiece (e.g., a selected portion of each part of a lead frame). In one embodiment, a plating system is configured to plate a selected portion a workpiece and at least partially compensate for wheel run out. The plating system includes a tank configured to hold a plating solution and a rotatable wheel disposed at least partially within the tank. The rotatable wheel includes a periphery having a plurality of masking-belt engagement features. The plating system further includes a masking belt set defining a longitudinally-oriented strip opening and including a plurality of wheel engagement features configured to engage with the plurality of masking-belt engagement features. The plating system also includes a backing masking belt extending along a portion of the rotatable wheel. The masking belt set and backing masking belt may be positioned so that the selected portion of the workpiece is progressively exposed to the plating solution through the strip opening when advanced into the plating solution between the masking belt set and backing masking belt. A tracking mechanism may be provided that is configured to guide the workpiece into the plating solution and move the workpiece laterally responsive to lateral movement of the rotatable wheel so that the selected portion of the workpiece is maintained in substantial alignment with the strip opening during entry into the plating solution.

In another embodiment, a plating system is configured to plate a selected portion of a workpiece and provide for controllably adjusting plating dimensions of the selected portions to be plated. The plating system includes a tank configured to hold a plating solution, a masking belt set defining a longitudinally-oriented strip opening having a width and a plurality of wheel engagement features, and a backing masking belt. The plating system further includes a rotatable wheel disposed at least partially within the tank and configured to controllably adjust the width of the strip opening of the masking belt set. The rotatable wheel includes a periphery having the backing masking belt extending along a portion thereof. The periphery includes a plurality of masking-belt engagement features configured to engage with the plurality of wheel engagement features. The masking belt set and backing masking belt may be positioned so that the selected portion of the workpiece is progressively exposed to the plating solution through the strip opening when advanced into the plating solution between the masking belt set and backing masking belt.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to plating systems configured to strip plate a selected portion of a workpiece (e.g., a selected portion of each part of a lead frame) and, at least partially compensate for wheel run out, improve masking belt tracking, and/or provide for controllably adjusting dimensions and/or a location of plating on the selected portion to be plated. For example, a lead frame to be plated may carry tines that may be used in an electrical connector jack to establish electrical contact with electrical contacts of an electrical plug inserted into the electrical connector jack.

Figure 1:
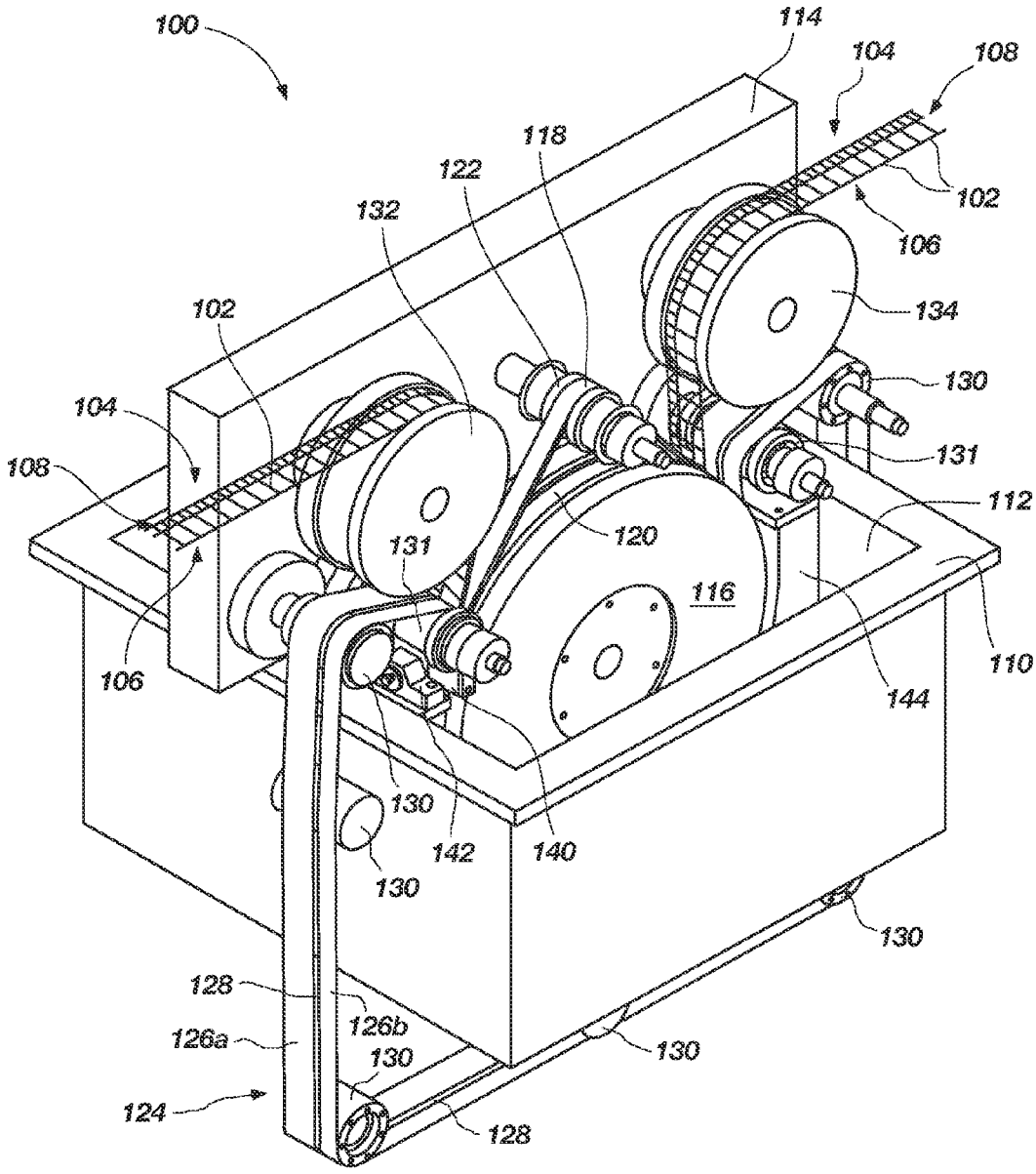
FIG. 1 is a front isometric view of an embodiment of a plating system.

FIG. 1 is a front isometric view of a plating system 100 according to an embodiment of the invention. The plating system 100 is configured to plate a selected portion of each of a plurality of duplicate parts 102 serially arranged along a lead frame 104 having a first side 106 to be plated and an opposing second side 108. The plating system 100 includes a tank 110 configured to hold a plating solution 112 and a support structure 114 for supporting various other components of the plating system 100.

The plating system 100 includes a rotatable drive wheel 116 mounted to the support structure 114 and operably coupled to a drive system (not shown) for effecting rotation thereof. The wheel 116 is disposed at least partially in the plating solution 112 held by the tank 110. The wheel 116 may be made from an electrically non-conductive material (e.g., a polymeric material) so that metal is not unintentionally plated onto the wheel 116 from the plating solution 112. A continuous backing masking belt 118 extends circumferentially about a major portion of a periphery of the wheel 116 and may reside in a circumferentially-extending slot 120 formed in the wheel 116 along such major portion. One or more pulleys 122 may be mounted to the support structure 114 and positioned to provide a selected amount of tension to the masking belt 118, with the masking belt 118 extending partially about the pulley 122.

The plating system 100 further includes a continuous masking belt set 124 comprised of a continuous first masking belt 126*a* and a continuous second masking belt 126*b* that are spaced from each other to define a longitudinally-oriented strip opening 128 that enables the plating solution 112 to contact the selected portions of the lead frame 104 exposed therethrough. The masking belt set 124 also extends about a major portion of the periphery of the wheel 116, and further extends partially about a plurality tracking rollers 130 that may be mounted to the support structure 114 and positioned along the path of the masking belt set 124 to help keep the masking belt set 124 in proper alignment with the lead frame 104. A plurality of belt pulleys 131 are also positioned along the path of the masking belt set 124 to help dampen tension variations and vibration induced in the masking belt set 124 by applying force to the masking belt set 124 as it moves along its path. The masking belt set 124 may be fabricated from a commercially available rubber transmission belt or another suitable material capable of surviving the associated mechanical and environmental stress of plating processing.

It is noted that in other embodiments, the drive wheel 116 may be replaced with a passive wheel. For example, one or more drive wheels other than the wheel 116 may be positioned along the path of the masking belt 118 and masking belt set 124 and operable to drive the masking belts 118 and masking belt set 124 to effect movement of the lead frame 104 into the plating solution 112.

The plating system 100 further includes first and second cathode drums 132 and 134 mounted to the support structure 114 and configured to impart a negative charge to the electrically conductive lead frame 104 so that positively charged metal ions in the plating solution 112 are attracted to the selected portion of the lead frame 104 exposed through the slot 128 and plated thereon.

Figure 2:
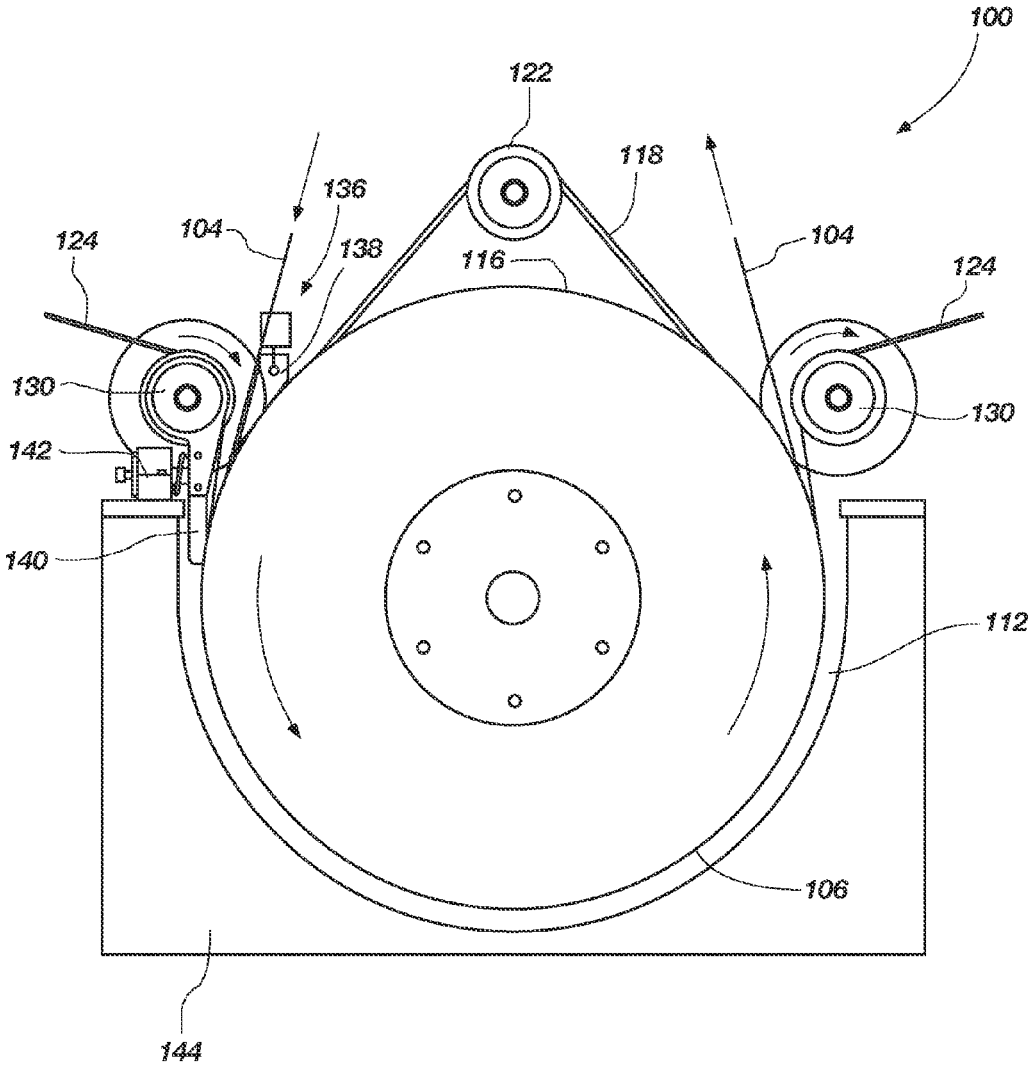
FIG. 2 is a side elevation view of the plating system shown in FIG. 1 with the tank removed for clarity.

Referring to the side elevation view of FIG. 2 in which the tank 110 has been removed for clarity, the plating system 100 further includes a tracking mechanism 136 mounted to the support structure 114. The tracking mechanism includes a guide assembly 138 configured to laterally align the selected portion of each part 102 of the lead frame 104 to be plated with the strip opening 128 of the masking belt set 124 at least during entry of each part 102 into the plating solution 112. The lead frame 104 extends partially about the first cathode drum 132 and between the masking belt 118 and masking belt set 124.

Referring primarily to FIG. 2, a compliance arm 140 and an associated actuator mechanism 142 may be provided, with the actuator mechanism 142 configured to controllably bias the compliance arm 140 so that the masking belt set 124 is urged toward the masking belt 118 to thereby compress and selectively seal the portion of the lead frame 104 advancing into the plating solution 112 therebetween. For example, the actuator mechanism 142 may include a spring mechanism, a pneumatic mechanism, or another suitable actuation mechanism configured to apply an adjustable amount of force to the compliance arm 140.

A fluted anode band 144 or other suitable anode may be disposed in the plating solution 112. The fluted anode band 144 may be positioned in close proximity to the wheel 116 and include passageways (not shown) through which the plating solution 112 may be continuously pumped to contact the selected portion of each part 102 of the lead frame 104 to be plated that is immersed in the plating solution 112. An electrochemical cell is formed by the negatively charged lead frame 104 (i.e., the cathode), the fluted anode band 144, and the plating solution 112 (i.e., the electrolyte).

During use, rotation of the drive wheel 116 serially advances each part 102 of the lead frame 104 between the masking belt 118 and masking belt set 124 and into the plating solution 112. The controllable force applied by the compliance arm 140 helps the masking belt 118 substantially seal the second side 108 of the lead frame 104 from the plating solution 112 into which each part 102 is serially advanced. Furthermore, the masking belt 118 may be made from a relatively more compliant material than the masking belts 126*a* and 126*b* of the masking belt set 124 so that the lead frame 104 is slightly depressed into the masking belt 118 to help prevent relative lateral movement between the lead frame 104 and the masking belt 118 as the lead frame 104 is advanced into the plating solution 112 and through the plating solution 112. The masking belt set 124 masks portions of the first side 106 of the lead frame 104 that are not desired to be plated. The selected portion of each part 102 of the lead frame 104 on the first side 106 is serially exposed to the plating solution 112 through the strip opening 128 of the masking belt set 124 during advancement into and through the plating solution 112 to thereby result in metal being plated on the selected portion of each part 102. After plating, each part 102 of the lead frame 104 sequentially separates from the masking belt 118 and masking belt set 124 as it is pulled out of the plating solution 112 by continued rotation of the wheel 116.

Figure 3:
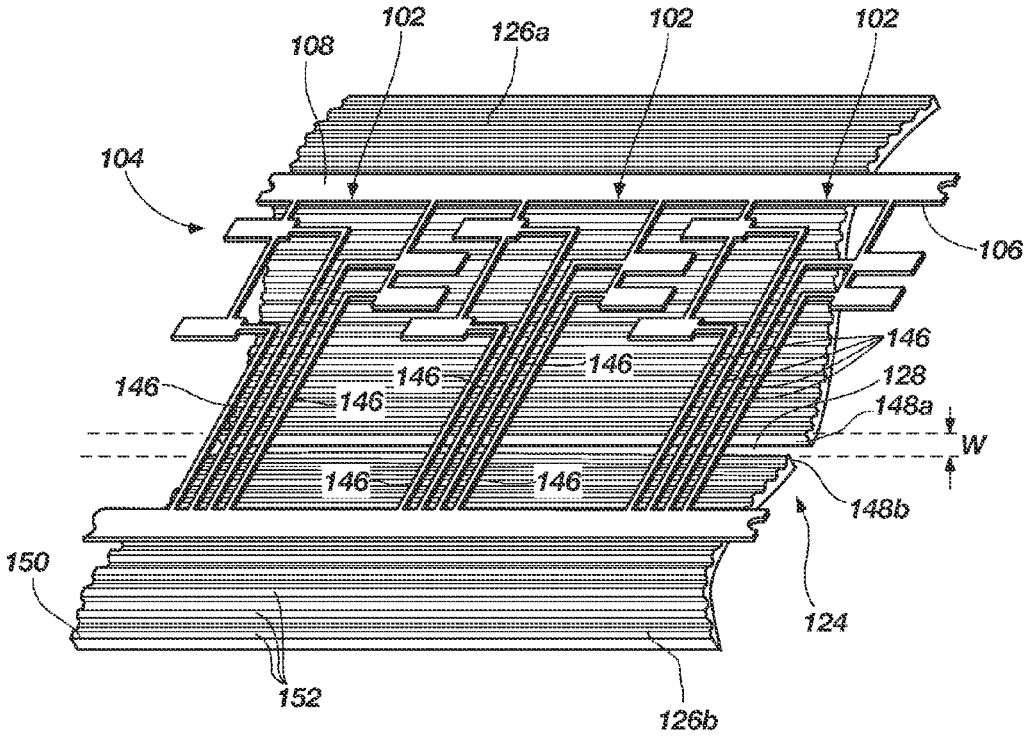
FIG. 3 is a partial isometric view with the backing masking belt omitted for clarity.

Referring to the partial isometric view of FIG. 3 in which the backing masking belt 118 is omitted for clarity, the illustrated lead frame 104 includes the duplicate parts 102 each of which may include multiple tines 146 to be plated through the strip opening 128 of the masking belt set 124. However, it is noted that the illustrated lead frame 104 is merely one of many possible configurations that may be plated. The spacing between edge 148*a* of the masking belt 126*a* and edge 148*b* of masking belt 126*b* may approximately define a width W of the strip opening 128 and, consequently, an approximate width of the metal plating plated onto the tines 146 of each part 102. In some embodiments, the edge 148*a* and 148*b* may each be beveled and slant away from each other to help reduce any of the aforementioned wall effect during plating.

Still referring to FIG. 3, the masking belt 126*a* and 126*b* each include a contact surface 150 including a plurality of longitudinally-extending teeth 152 (e.g., V-shaped teeth) that function as wheel engagement features. Referring to the enlarged, front isometric view of FIG. 4A and the partial cross-sectional view of FIG. 4B, the teeth 152 of the masking belts 126*a* and 126*b* engage (e.g., mesh) with complementarily configured teeth 154 (e.g., V-shaped teeth) formed along the periphery of the wheel 116. The teeth 154 of the wheel 116 function as masking-belt engagement features and engage with the teeth 152 of the masking belt set 124 so that the masking belts 126*a* and 126*b* move laterally as the wheel 116 moves laterally (e.g., wheel run out of about 0.020 inches to about 0.030 inches) with the wheel 116 to thereby help maintain a lateral position of the strip opening 128 relative to the tines 146 (FIG. 3) of the lead frame 104 during plating. Thus, the masking belts 126*a* and 126*b* of the masking belt set 124 may move laterally with the wheel 116 the same or similar extent as the wheel 116. Additionally, the effects of belt stretching, pulley axial misalignment, and/or other belt/pulley issues may be substantially reduced or eliminated due to the teeth 152 formed in the masking belts 126*a* and 126*b* of the masking belt set 124 engaging with the teeth 154 of the wheel 116 to help maintain lateral alignment of the strip opening 128 with respect to the lead frame 104. Furthermore, the masking belts 126*a* and 126*b* of the masking belt set 124 may exhibit a thickness below about 0.050 inch to about 0.100 inch to reduce the aforementioned wall effect because potential trans-linear movement of the masking belt set 124 may be limited due to wheel-engagement features of the masking belt set 124 and the masking-belt engagement features of the wheel 116 limiting or eliminating such trans-linear movement that ordinarily would occur with such belt thicknesses.

Figure 4A:
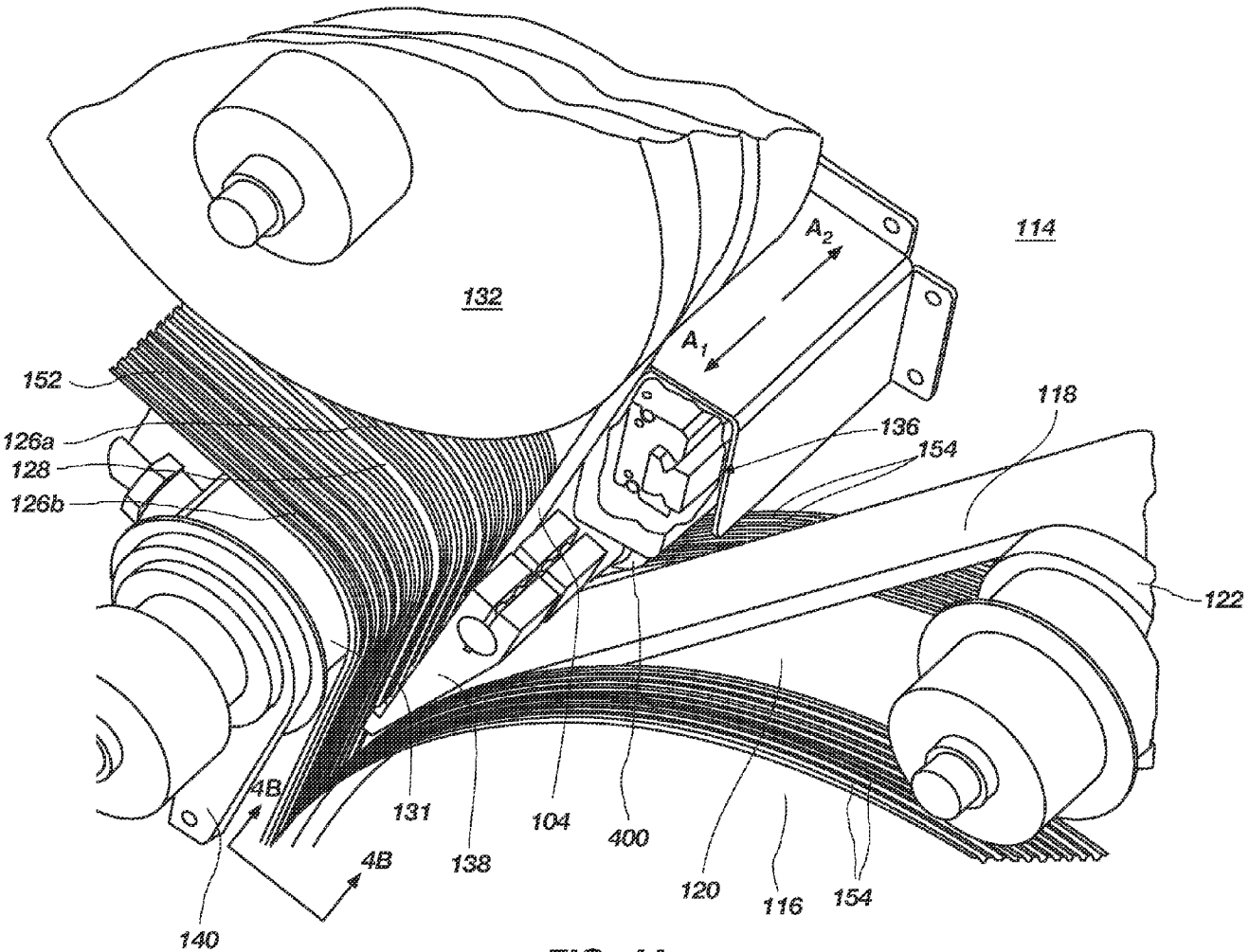
FIG. 4A is an enlarged, front isometric view of the plating system shown in FIG. 1.
Figure 4B:
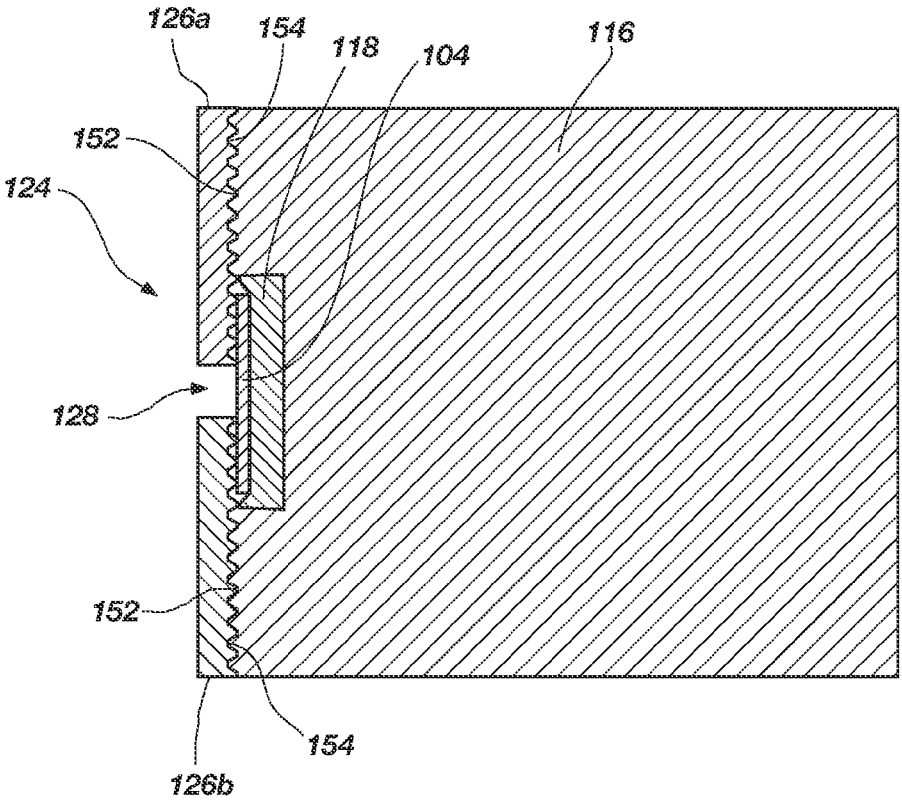
FIG. 4B is a partial cross-sectional view taken along line 4B-4B in FIG. 4A.

Referring now to only FIG. 4A, the tracking mechanism 136 may include a rotatable tracking wheel 400 that also includes teeth 518 (FIGS. 5A and 5B) configured to engage (e.g., mesh) with the complementarily configured teeth 154 of the wheel 116 to substantially fix the guide assembly 138 in a lateral position with respect to the wheel 116. The tracking mechanism 136 is also configured so that as the wheel 116 moves laterally (e.g., wheel run out of about 0.020 inches to about 0.030 inches), the guide assembly 138 may also move in lateral directions $A_1$ or $A_2$ to the same or similar extent as the wheel 116 to help maintain the lateral position of the tines 146 (FIG. 3) to be plated relative to the strip opening 128 of the masking belt set 124 during plating. Accordingly, the combination of the masking belt set 124 and wheel 116 both having complementarily configured engagement features and the tracking mechanism 136 being configured to move laterally in the directions $A_1$ and $A_2$ helps at least partially or substantially completely compensate for run out of the wheel 116 and more accurately plate the tines 146 (FIG. 3) in a desired lateral location to limit the amount of overplating on the lead frame 104. Thus, the amount of metal plated onto the tines 146 (FIG. 3) may be conserved, which can result in substantial reduction in manufacturing costs when the metal is a precious metal such as gold.

The lateral position of the strip opening 128 of the masking belt set 124 may be adjusted by loosening the masking belts 126*a* and 126*b* and moving the masking belts 126*a* and 126*b* further apart or closer together, as desired. For example, the masking belts 126*a* and 126*b* may each be moved in one pitch increments defined by teeth 152.

Figure 5A:
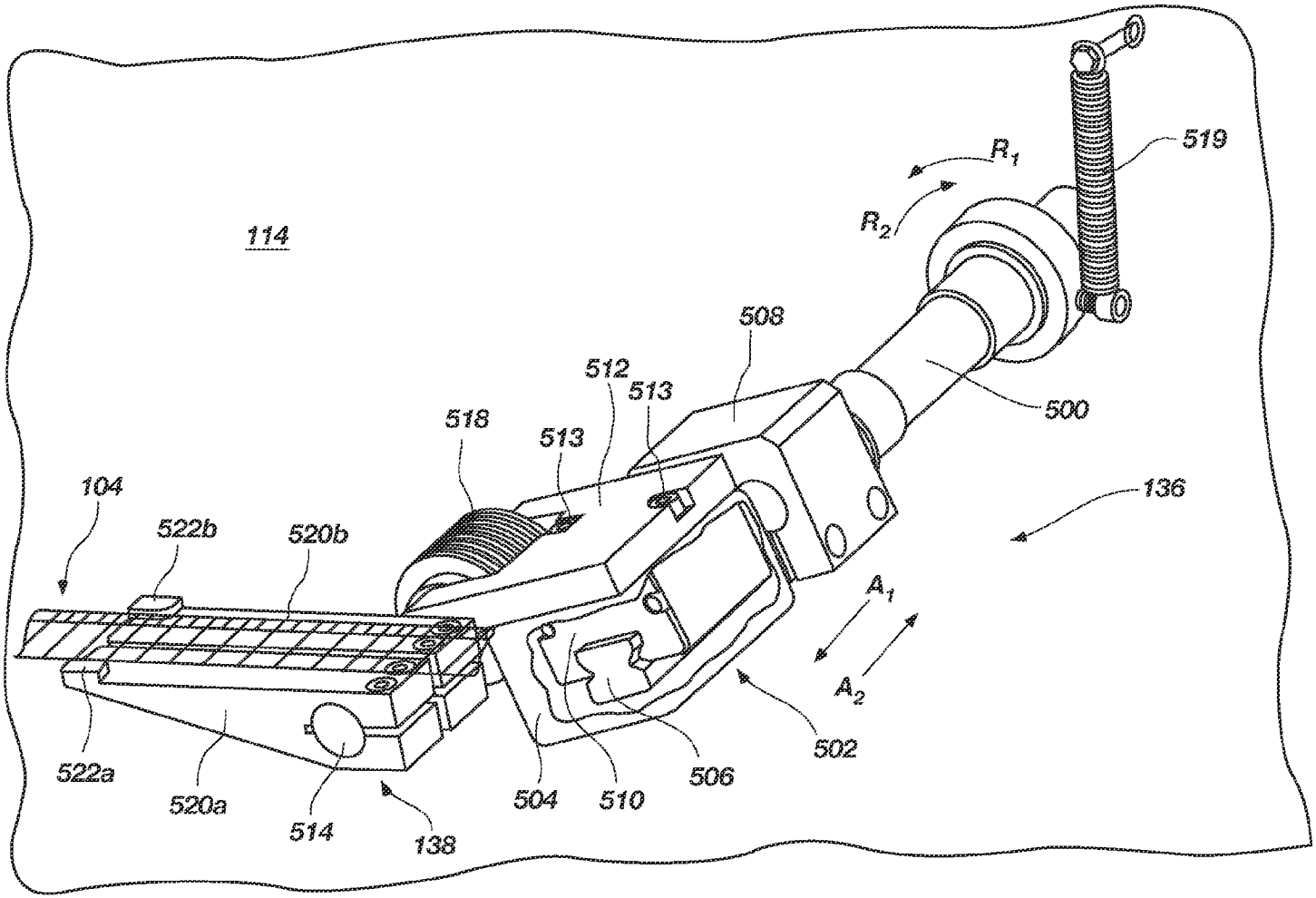
FIG. 5A is an isometric cut-away view of the embodiment of the tracking mechanism shown in FIGS. 1-3.
Figure 5B:
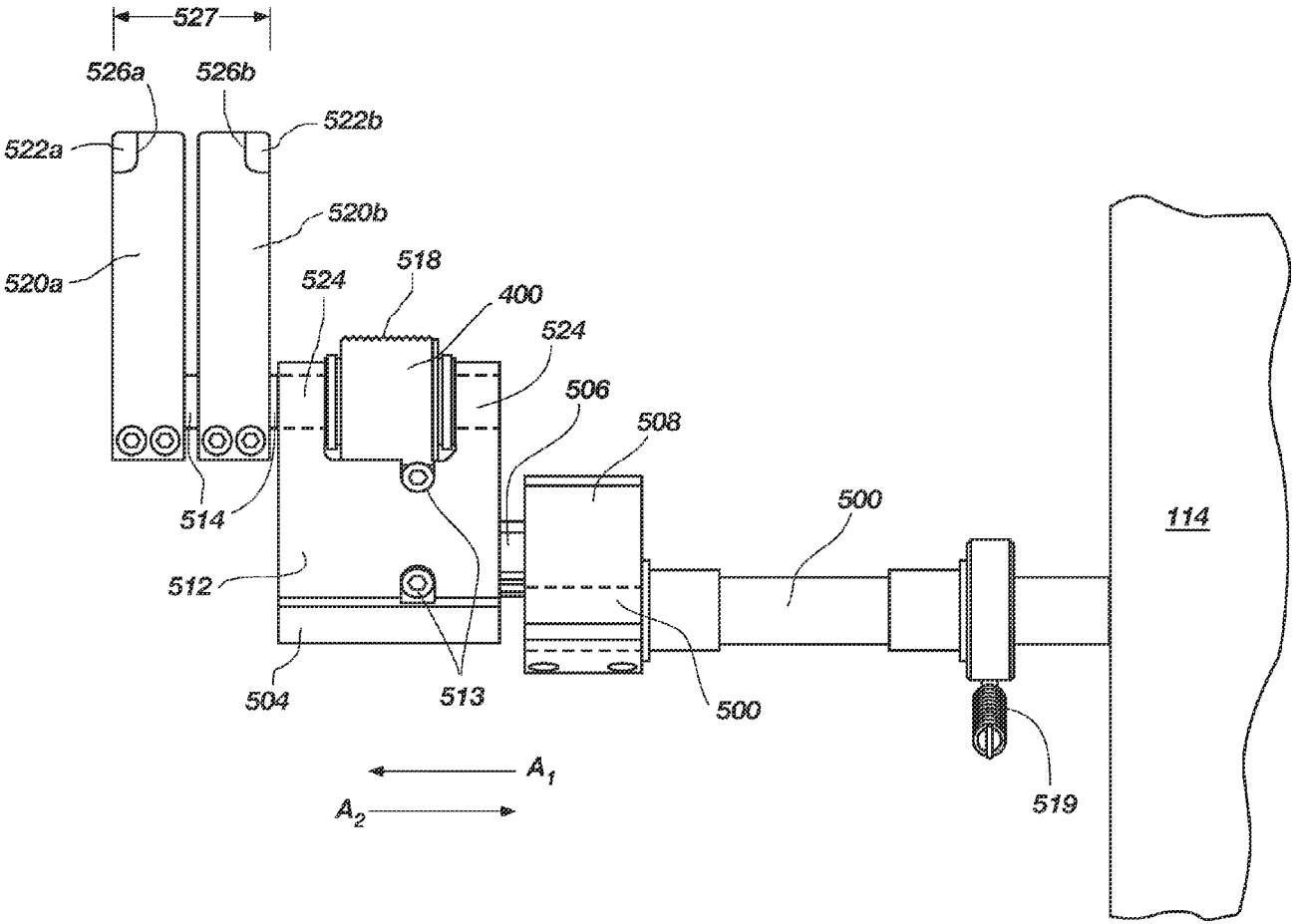
FIG. 5B is a top plan view of embodiment of the tracking mechanism shown in FIGS. 1-3.

FIGS. 5A and 5B are isometric cut-away and top plan views, respectively, of the illustrated embodiment of the tracking mechanism 136 shown in FIGS. 1-3. The tracking mechanism 136 includes a support arm 500 rotatably mounted to the support structure 114 and extending laterally in a direction across the paths of the masking belt 118 and masking belt set 124. The support arm 500 is configured to rotate in directions $R_1$ and $R_2$. The tracking mechanism 136 further includes a linear bearing assembly 502 housed in a protective housing 504 (partially cut away) that protects the components thereof from the plating solution 112. The linear bearing assembly 502 includes a bearing rail 506 that is connected to the support arm 500 via a coupling member 508. The linear bearing assembly 502 further includes a bearing race 510 that is configured to slide in the directions $A_1$ and $A_2$ along and on the bearing rail 506. For example, the linear bearing assembly 502 may be configured as a non-circulating linear bearing assembly, a re-circulating linear bearing assembly, or another suitable low-friction linear motion system. A bracket 512 may be mounted to the housing 504 and bearing race 510 using one or more fasteners 513. A shaft 514 is mounted to the bracket 512 and carries the guide assembly 138 and the tracking wheel 400 that is rotatable about the shaft 514. The tracking wheel 400 is positioned above the wheel 116 and the teeth 518 thereof are configured to engage (i.e., mesh) with the teeth 154 of the wheel 116. An extension spring 519 or other type of biasing element may be coupled to an end of the support arm 500 and a selected location of the support structure 114 to bias the tracking wheel 400 so that the teeth 518 thereof firmly engage with the teeth 154 of the wheel 116.

Still referring to FIGS. 5A and 5B, the guide assembly 138 includes lead frame guide elements 520*a* and 520*b* that may be mounted to the shaft 514, such as via a clamp fit that enables an orientation about the shaft 514 and lateral spacing to be controllably adjusted. The guide elements 520*a* and 520*b* each include a corresponding guide portion 522*a* and 522*b* between which the lead frame 104 is advanced. Interior edges 526*a* and 526*b* of corresponding guide portions 522*a* and 522*b* may be spaced a distance 527 that is approximately equal to or slightly larger than a width of the lead frame 104 advancing therethrough. The distance 527 may be controlled by moving the guide elements 520*a* and 520*b* closer to together or further apart, as desired, so that lead frames of different widths may be accommodated. As the wheel 116 runs out during rotation, the guide assembly 138 moves therewith due to the tracking wheel 400 being engaged with the wheel 116 and the guide assembly 138 moving laterally with movement of the bearing race 510 so that a lateral position of the lead frame 104 remains substantially fixed relative to the strip opening 128 (FIG. 4A) of the masking belt set 124 (FIG. 4A).

Although the tracking mechanism 136 is configured as a passive tracking mechanism that moves passively responsive to the lateral movement of the wheel 116, in other embodiments, the tracking mechanism may be active. For example, the tracking mechanism may include an electronic sensor that is configured to track the run out of the wheel 116 and an actuator may move a lead frame guide element responsive to the sensed wheel run out a selected amount to compensate for the wheel run out.

Figure 6:
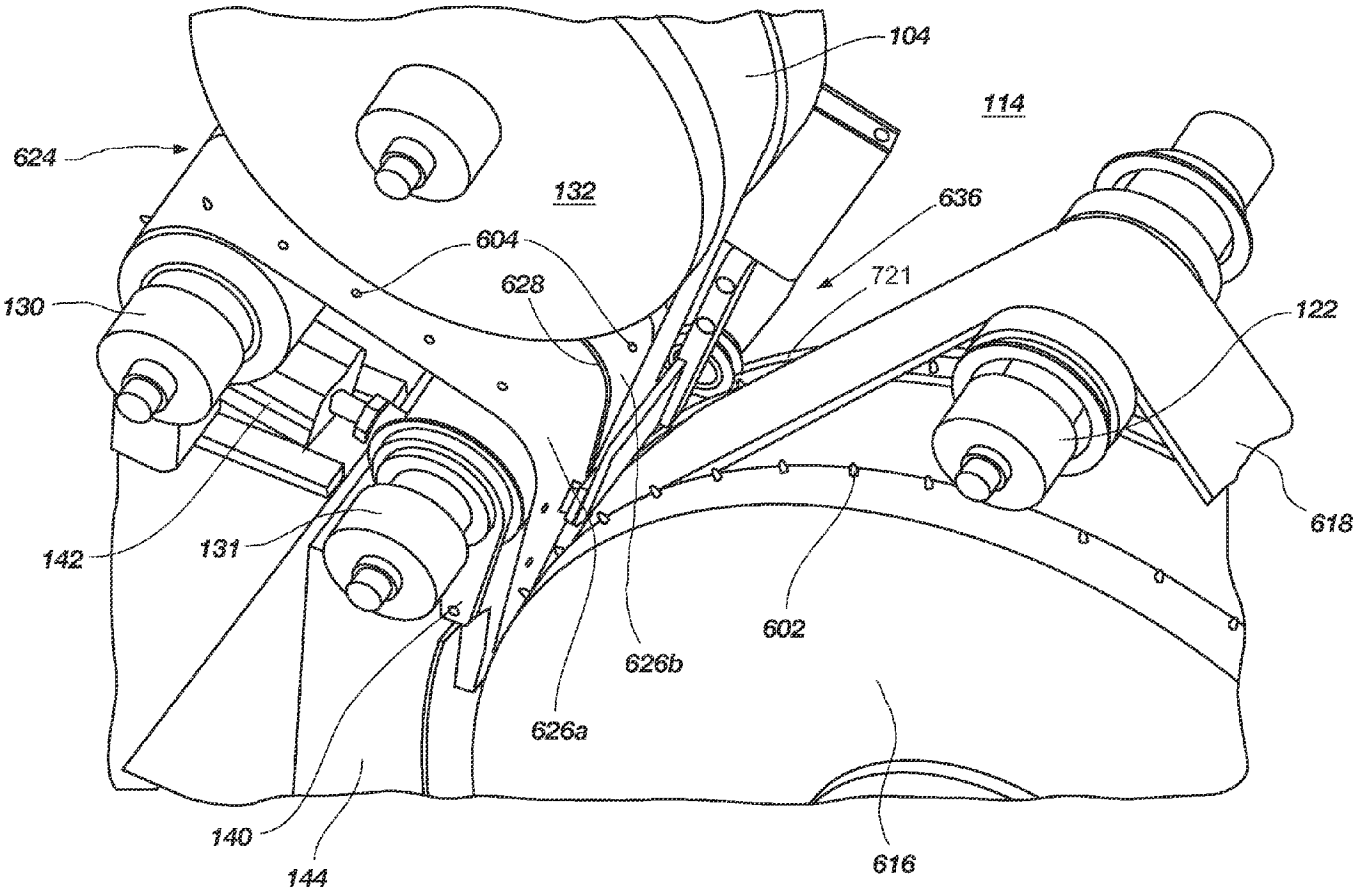
FIG. 6 is an enlarged, front isometric view of another embodiment of a plating system.

FIG. 6 is an enlarged, front isometric view of another embodiment of a plating system 600. In the interest of brevity, components in the plating systems 100 and 600 that are identical to each other have been provided with the same reference numerals, and an explanation of their structure and function will not be repeated unless the components function differently in the two plating systems 100 and 600. The rotatable wheel 616 of the plating system 600 differs from the wheel 116 shown in FIG. 1 in that it includes a plurality of guide pins 602 extending radially outwardly from a periphery of the rotatable wheel 616 and substantially equally spaced along the periphery a selected pitch. Each guide pin 602 may be press-fitted with, threadly coupled to, or secured to the rotatable wheel 616 in another suitable manner. A masking belt set 624 includes masking belts 626*a* and 626*b* spaced to define a longitudinally-oriented strip opening 628. The masking belts 626*a* and 626*b* each include substantially equally longitudinally spaced guide holes 604 having a pitch that is substantially the same as the pitch of the guide pins 602 on the rotatable wheel 616.

During use, the guide pins 602 sequentially engage corresponding guide holes 604 in the masking belts 626*a* and 626*b* as the rotatable wheel 616 rotates so that a lateral position of the strip opening 628 stays relatively constant as the masking belt set 624 passes through the plating solution 112. When the rotatable wheel 616 runs out during rotation, the combination of the guide pins 602 and guide holes 604 enables the masking belt 624 to move laterally to compensate for the wheel run out in a similar manner to the combination of teeth 154 of the wheel 116 and the teeth 152 of the masking belt set 124 best depicted in FIGS. 4A and 4B.

Figure 7A:
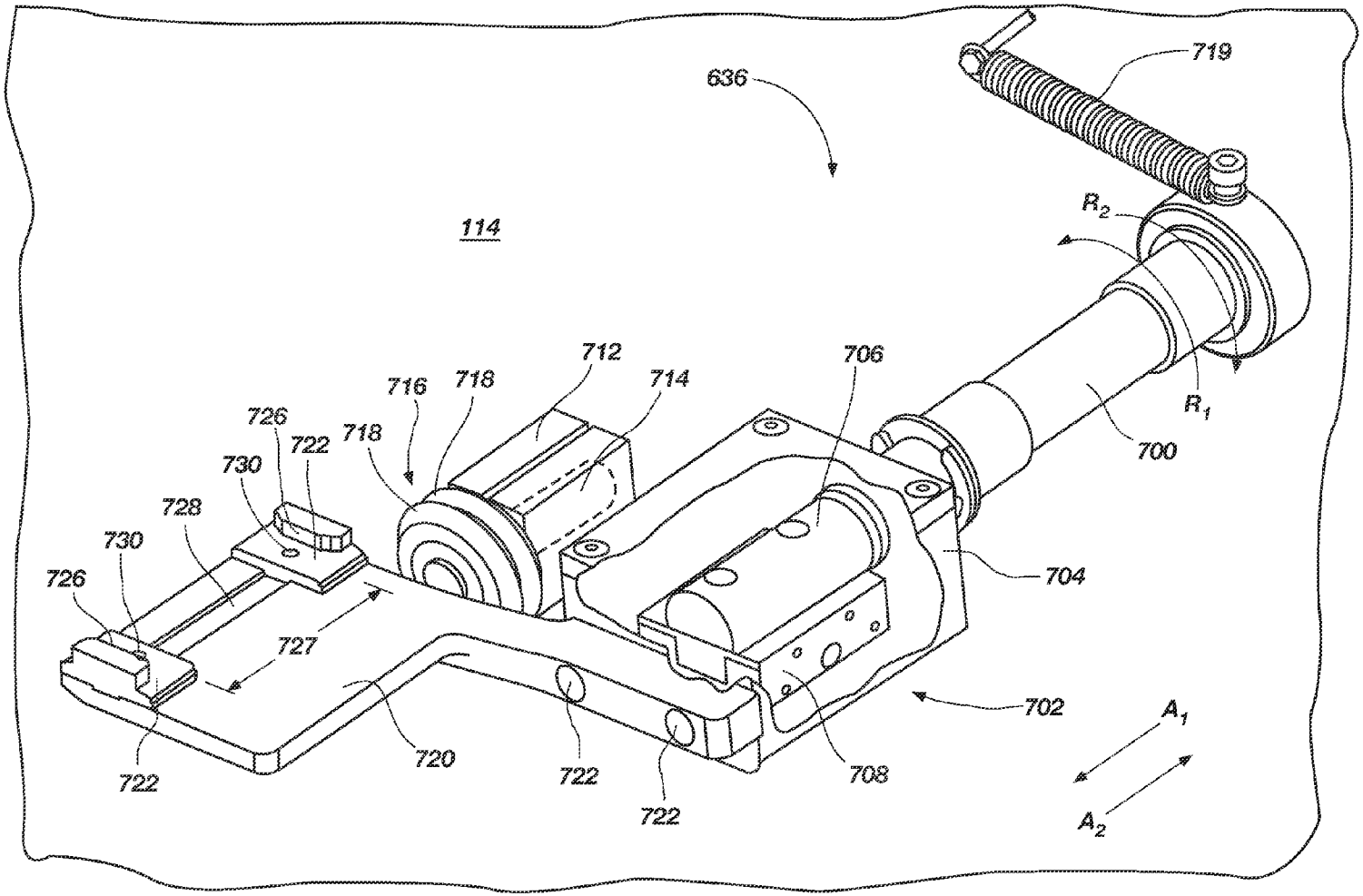
FIG. 7A is an isometric cut-away view of the embodiment of the tracking mechanism shown in FIG. 6.
Figure 7B:
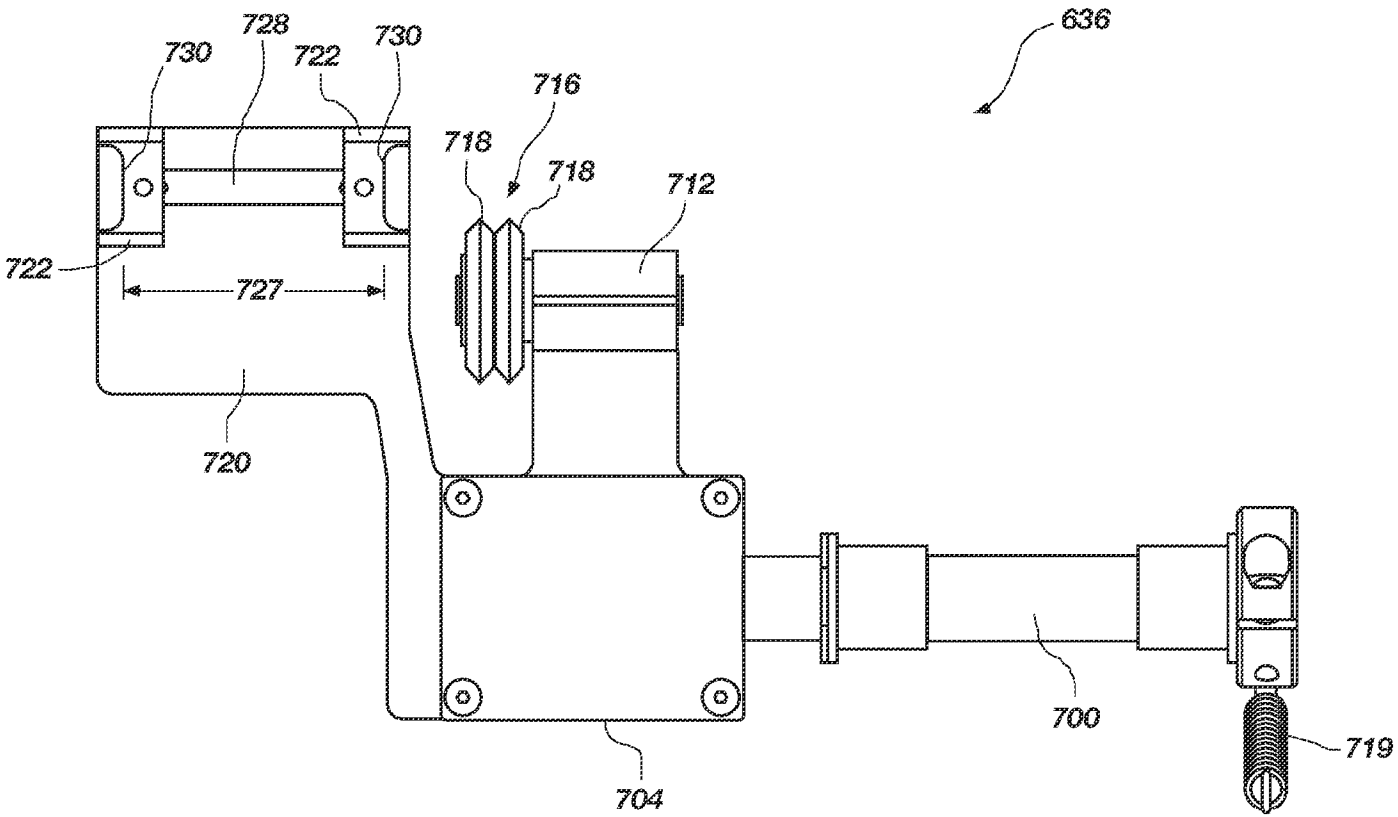
FIG. 7B is a top plan view of the embodiment of the tracking mechanism shown in FIG. 6.

The plating system 600 also includes a tracking mechanism 636 configured to guide the lead frame 104 into the plating solution 112 and maintain the lateral position of the strip opening 628 relative to the lead frame 104 as the lead frame 104 enters into the plating solution 112. FIGS. 7A and 7B are isometric cut-away and top plan views, respectively, of the embodiment of the tracking mechanism 636 shown in FIG. 6. The tracking mechanism 636 includes a support arm 700 rotatably mounted to the support structure 114 and extending laterally in a direction across the path of the masking belts 618 and 624. The support arm 700 is configured to rotate in directions $R_1$ and $R_2$. The tracking mechanism 636 further includes a linear bearing assembly 702 housed in a protective housing 704 (partially cut away) that protects the components thereof from the plating solution 112. The linear bearing assembly 702 includes a bearing rail 706 that may be integral with or attached to the support arm 700, and a bearing race 708 that is configured to slide in the directions $A_1$ and $A_2$ along and on the bearing rail 706. For example, the linear bearing assembly 702 may be configured as a non-circulating linear bearing assembly, a re-circulating linear bearing assembly, or another suitable linear motion system. A bracket 712 may be mounted to the housing 704 and supports a shaft 714 that carries a tracking wheel 716 that is rotatable about the shaft 714. The tracking wheel 716 is positioned above the rotatable wheel 616 and has teeth 718 configured to reside in corresponding grooves 721 (FIG. 6) formed in the rotatable wheel 616. An extension spring 719 or other type of biasing element may be coupled to an end of the support am 700 and a selected location of the support structure 114 to bias the tracking wheel 716 so that the teeth 718 thereof securely reside in the grooves 721 of the rotatable wheel 616.

Still referring to FIGS. 7A and 7B, the guide assembly 638 includes a guide member 720 that may be mounted to the housing 704 and attached to the bearing race 708, such as via fasteners 722. The guide member 720 includes lead frame guide elements 722 that may be slidably attached to the guide member 720 between which the lead frame 104 is advanced. Interior edges 726 of each guide element 722 may spaced a distance 727 that is approximately equal to or slightly larger than a width of the lead frame 104 advancing therethrough. The distance 727 may be controlled by moving the guide elements 722 closer to together or further apart, as desired, along a slot 728 formed in the guide member 720. For example, each guide element 722 may be secured on guide member 720 via a fastener 730 that extends through the slot 728 to enable quick and easy adjustment of the distance 727.

As the rotatable wheel 616 runs out during rotation, the guide assembly 738 moves therewith due to the tracking wheel 716 being engaged with the rotatable wheel 616 and the guide assembly 738 moving laterally with movement of the bearing race 708 so that a lateral position of the lead frame 104 remains substantially fixed relative to the strip opening 628 of the masking belt 624.

It is noted that although the different plating system embodiments are described above in the context of plating a selected portion of each of a plurality of serially arranged parts of a lead frame, in other embodiments, the plating systems may be employed to plate an elongated strip on a workpiece configured as a metallic strip. Referring again to FIG. 1, in an embodiment, a metallic strip may be advanced into the plating solution 112 between the masking belt sets 124 and the backing masking belt 118 so that a selected continuous strip portion of the metallic strip is progressively exposed through the strip opening 128 resulting in the selected continuous strip portion being plated. Then, the metallic strip may be subsequently cut into a lead frame so that sections of the selected continuous strip portion form part of multiple tines cut from the metallic strip.

Figure 8A:
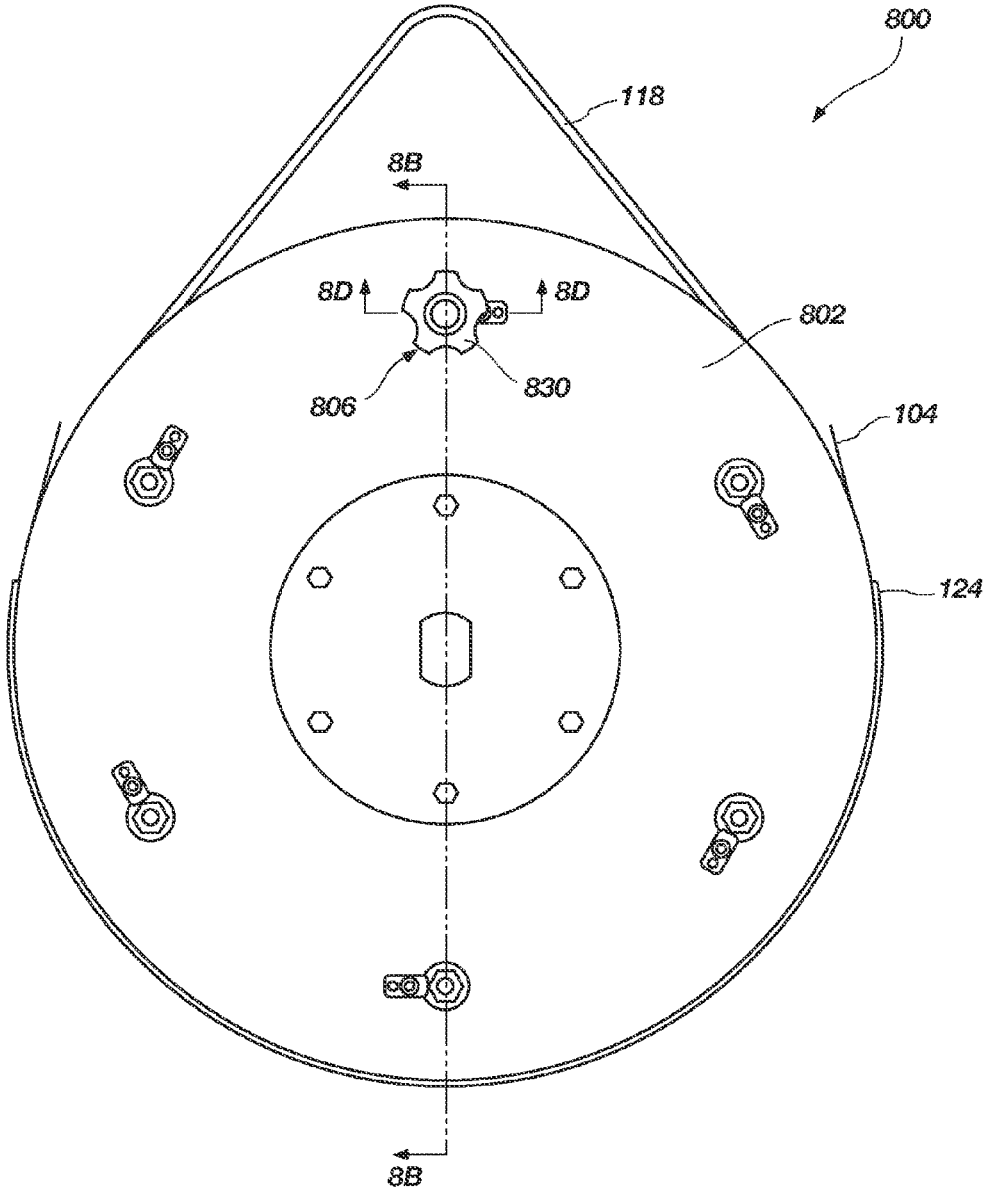
FIG. 8A is a plan view of a rotatable drive wheel configured to controllably adjust a width of a strip opening of a masking belt.
Figure 8B:
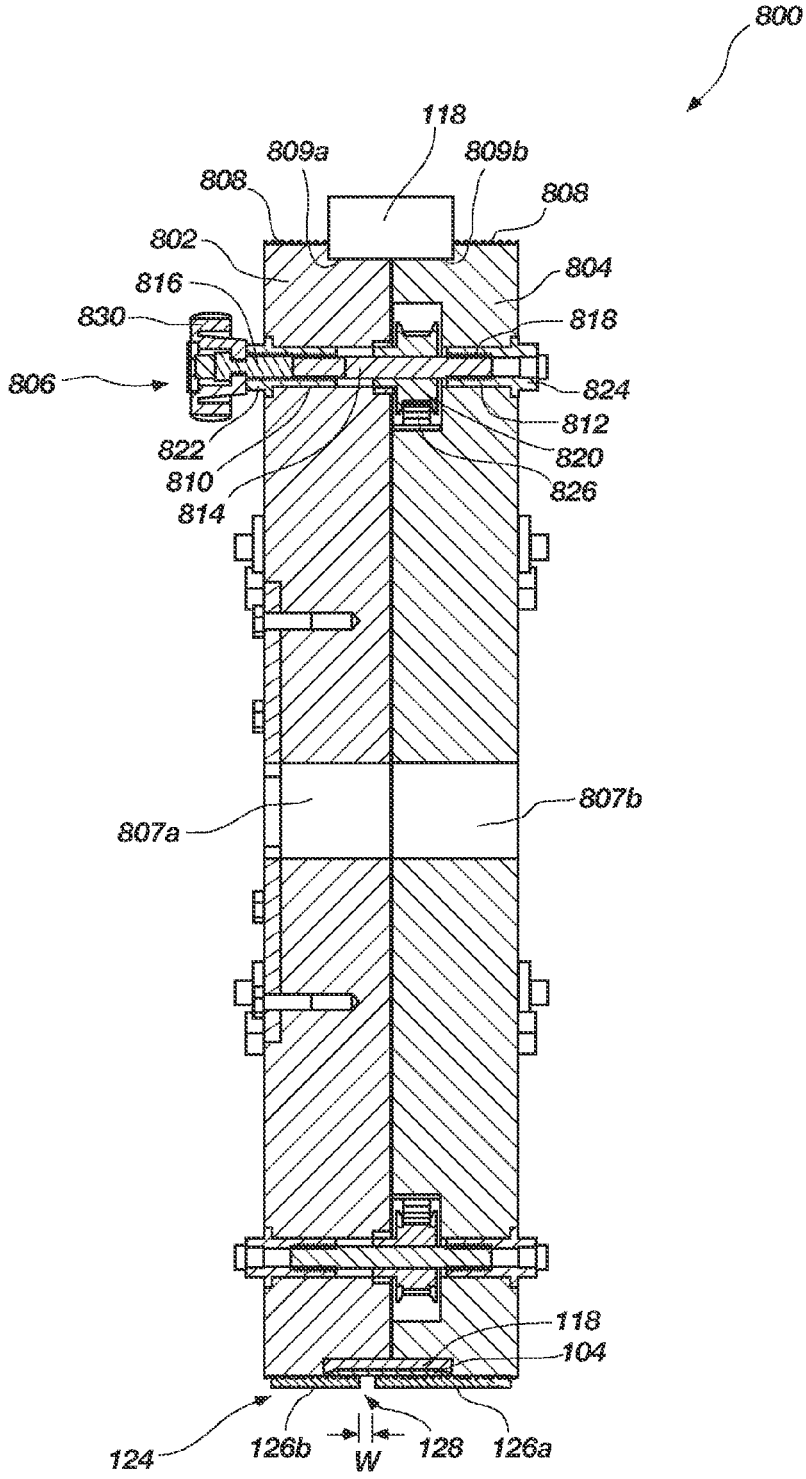
FIG. 8B is a cross-sectional view of the rotatable drive wheel shown in FIG. 8A taken along line 8B-8B.

A number of different configurations for the rotatable drive wheels described in the aforementioned plating systems may be employed. The rotatable drive wheel may be configured so that a strip opening of a masking belt may be controllably adjusted. FIGS. 8A and 8B are plan and cross-sectional views, respectively, of a rotatable drive wheel 800 configured to controllably adjust a width of a strip opening a masking belt set extending thereabout. The rotatable drive wheel 800 includes a first plate 802 and a second plate 804 interconnected to each other via a plurality of fastener assemblies 806. Generally centrally located through holes 807*a* and 807*b* extend through corresponding first and second plates 802 and 804 for receiving a drive shaft (not shown) associated with a drive system (not shown) operable to rotate the rotatable drive wheel 800. A periphery of each of the first and second plates 802 and 804 includes circumferentially-extending teeth 808 (e.g., V-shaped teeth) that are configured to engage with the masking belts 126*a* and 126*b* of the masking belt set 124. The masking belt 118 may reside in a slot formed by a circumferentially-extending slot 809*a* in the first plate 802 and a circumferentially-extending slot 809*b* in the second plate 804.

Each fastener assembly 806 extends through a through hole 810 formed in the first plate 802 and a through hole 812 formed in the second plate 804. Each fastener assembly 806 includes a shaft 814 having a first threaded portion 816, a second threaded portion 818, and a drive portion 820 therebetween located in a countersink portion of the through hole 812. A first nut 822 may be threaded into each first through hole 810 and a second nut 824 may be threaded into each second through hole 812. In each fastener assembly 806, the first threaded portion 816 has a first type of threads (e.g., right-handed threads) that is threaded to the first nut 822 and the second threaded portion 818 has an opposite second type of threads (e.g., left-handed threads) that is threaded to the second nut 824.

Figure 8C:
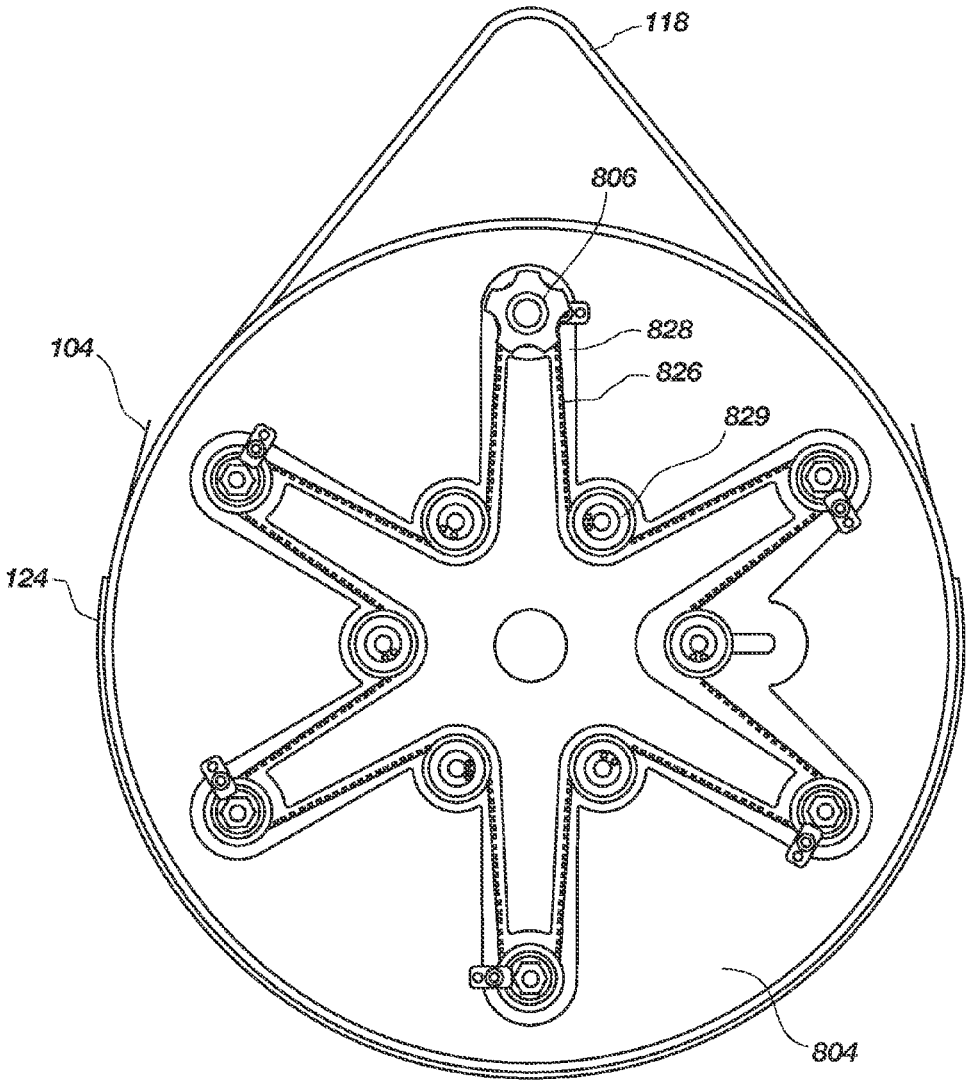
FIG. 8C is a plan view of the rotatable drive wheel shown in FIG. 8C in which the first plate is removed.

Referring to the plan view shown of the rotatable drive wheel 800 shown in FIG. 8C in which the first plate 802 is removed, a drive belt 826 (e.g., a transmission belt) may interconnect each drive portion 820 so that rotation of one of the fastener assemblies 806 turns all other ones of the fastener assemblies 806 approximately an equal amount. The drive belt 826 may reside in a cut out 828 formed in the second plate 804 and extend partially about tensioning pulleys 829 that enable adjusting the tension of the drive belt 826. One or more of the fastener assemblies 806 may include a control knob 830 connected to a corresponding shaft 814.

Figure 8D:
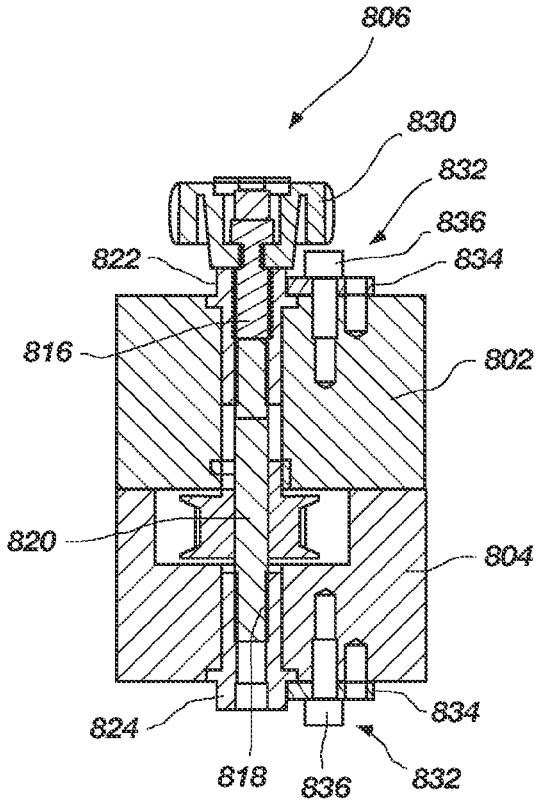
FIG. 8D is a cross-sectional view of the rotatable drive wheel shown in FIG. 8A taken along line 8D-8D.

Referring to FIG. 8A and the cross-sectional view of the rotatable drive wheel 800 shown in FIG. 8D, a plurality of cleats 832 may be fastened to the first plate 802 and the second plate 804. Each cleat 832 in the first plate 802 may include a retention clamp foot 834 that extends over a flanged portion of the nut 822 in the first plate 802 and a fastener 836 that compresses the retention clamp foot 834 against the flanged portion of the nut 822 when tightened to prevent the nut 822 from loosening. Each cleat 832 in the second plate 804 may include a retention clamp foot 834 that extends over a flanged portion of the nut 824 in the second plate 804 and a fastener 836 that compresses the retention clamp foot 834 when tightened against the flanged portion of the nut 822 to prevent the nut 824 from loosening. By loosening or tightening one or more selected nuts 822 and 824, a relative position between the first and second plates 802 and 804 may be adjusted so that first and second plates 802 and 804 are adjusted to be substantially parallel to each other. The cleats 832 may be employed to ensure that once the nuts 822 and 824 have been adjusted, as desired, they do not loosen by tightening the retention clamp feet 834 against a corresponding nut 822 and 824.

Once this fine adjustment has been performed, an operator may grasp and manually turn the control knob 830 to rotate the shaft 814 of all of the fastener assemblies 806 and cause the first and second plates 802 and 804 to move closer together or further apart (depending upon the direction of rotation) axially along the shafts 814 of the fastener assemblies 806. Moving the first and second plates 802 and 804 closer together or further apart moves the masking belts 126*a* and 126*b* closer together or further apart so that the width W of the strip opening 128 of the masking belt set 124 may be controllably adjusted. The first and second plates 802 and 804 may be moved closer together or further apart over a continuous range of at least about one full pitch defined by the teeth 152 of the masking belts 126*a* and 126*b*.

In another embodiment, the teeth 808 (FIG. 8B) formed circumferentially along the first and second plates 802 and 804 may be replaced with guide pins (e.g., the guide pins 602) that are substantially equally spaced along the periphery a selected pitch. Each guide pin may be press-fitted with, threadly coupled to, or secured to the first or second plate 802 or 804 in another suitable manner. Such a drive wheel may be used in the plating system 600 shown in FIG. 6.

Figure 9:
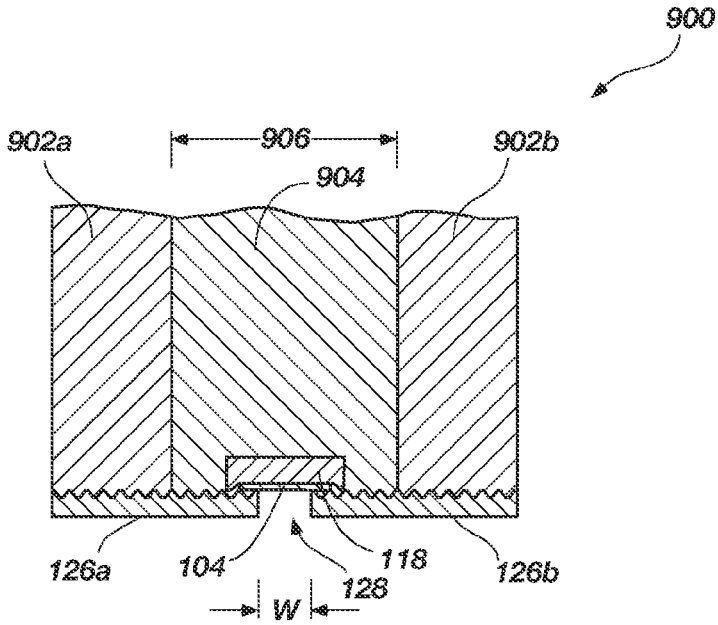
FIG. 9 is a partial cross-sectional view of an adjustable rotatable drive wheel according to another embodiment.

FIG. 9 is a partial cross-sectional view of an adjustable rotatable drive wheel 900 according to another embodiment. The drive wheel 900 includes a first outer plate 902*a*, a second outer plate 902*b*, and a replaceable core 904 positioned therebetween that has a thickness 906. The first outer plate 902*a*, a second outer plate 902*b*, and a replaceable core 904 may be secured to each other using one or more fasteners (not shown). The width W of the strip opening 128 between the masking belts 126*a* and 126*b* of the masking belt set 124 may be controllably adjusted by replacing the core 904 with a core having a different thickness 906. Although the drive wheel 900 is illustrated as using V-shaped teeth formed on the periphery of the first and second plates 902*a* and 902*b* configured to engage with V-shaped teeth formed on the masking belt set 124, in other embodiments, guide pins (e.g., the guide pins 602) may be provided that are substantially equally spaced along the periphery a selected pitch for use with a masking belt such as the masking belt 624 shown in FIG. 6.

While various aspects and embodiments of the invention have been disclosed herein, other aspects and embodiments will be apparent to those skilled in the art. The various aspects and embodiments disclosed herein are for purposes of illustration and are not intended to be limiting.

The invention claimed is:

1. A plating system configured to plate a selected portion of a workpiece, comprising:

a tank configured to hold a plating solution;

a rotatable wheel disposed at least partially within the tank, the rotatable wheel including a periphery having a plurality of masking-belt engagement features and the rotatable wheel further including tracking mechanism engagement features;

a masking belt set defining a longitudinally-oriented strip opening and including a plurality of wheel engagement features configured to engage with the plurality of masking-belt engagement features;

a backing masking belt extending along a portion of the rotatable wheel, the masking belt set and backing masking belt positioned so that the selected portion is progressively exposed to the plating solution through the strip opening when the workpiece is advanced into the plating solution between the masking belt set and backing masking belt; and a tracking mechanism configured to guide the workpiece into the plating solution and move the workpiece laterally responsive to lateral movement of the rotatable wheel so that the selected portion of the workpiece is maintained in substantial alignment with the strip opening during entry into the plating solution, the tracking mechanism further including a rotatable tracking roller positioned and configured to engage with the plurality of tracking mechanism engagement features of the rotatable wheel.

2. The plating system of claim 1 wherein the masking belt set comprises first and second masking belts laterally spaced to define the strip opening and each including a portion of the plurality of wheel engagement features.

3. The plating system of claim 1 wherein the masking belt set comprises a first masking belt having a first beveled edge and a second masking belt having a second beveled edge laterally spaced from the first beveled edge to define the strip opening, the first and second beveled edges being slanted away from each other.

4. The plating system of claim 1 wherein:

the plurality of wheel engagement features of the masking belt set comprise a plurality of longitudinally-extending teeth; and the plurality of masking-belt engagement features of the rotatable wheel comprise a plurality of circumferentially-extending teeth complementarily configured with the plurality of longitudinally-extending teeth.

5. The plating system of claim 1 wherein:

the plurality of wheel engagement features of the masking belt set comprise a plurality of guide holes; and the plurality of masking-belt engagement features of the rotatable wheel comprise a plurality of pins positioned to sequentially engage with the plurality of guide holes as the rotatable wheel rotates.

6. The plating system of claim 1 wherein the tracking mechanism comprises lead frame guide elements spaced a distance from each other.

7. The plating system of claim 1 wherein the tracking mechanism comprises:

a guide member configured to guide the workpiece into the plating solution; and a linear bearing assembly configured to allow the guide member to move laterally with the lateral movement of the rotatable wheel.

8. The plating system of claim 1 wherein the tracking mechanism is configured as a passive tracking mechanism that passively moves responsive to the lateral movement of the rotatable wheel.

9. The plating system of claim 1 wherein the tracking mechanism is configured as an active tracking mechanism that moves responsive to sensing the lateral movement of the rotatable wheel.

10. The plating system of claim 1, further comprising an actuator positioned and configured to bias the masking belt set toward the backing masking belt.

11. The plating system of claim 1 wherein the workpiece comprises a lead frame including a plurality of serially arranged parts, and further wherein each serially arranged part of the lead frame is sequentially exposed to the plating solution when each serially arranged part is sequentially advanced into the plating solution between the masking belt set and the backing masking belt as the rotatable wheel rotates.

12. The plating system of claim 1 wherein the workpiece is configured as a metallic strip.

13. The plating system of claim 1, further comprising a negatively charged cathode drum positioned to contact the workpiece.

14. The plating system of claim 1 wherein the rotatable wheel is configured as a drive wheel operable to advance the workpiece between the masking belt set and the backing masking belt into the plating solution.

15. The plating system of claim 1 wherein the rotatable wheel comprises a first outer plate, a second outer plate, and a removable core positioned therebetween.

16. The plating system of claim 1 wherein the rotatable wheel comprises a first plate including a first portion of the plurality of masking-belt engagement features and a second plate including a second portion of the plurality of masking-belt engagement features, the first and second plates coupled to each other via one or more fastener assemblies configured to controllably adjust a spacing between the first and second plates.

17. The plating system of claim 1 wherein the lateral movement of the rotatable wheel during rotation thereof is wheel run out, and further wherein the first masking belt and the tracking mechanism each moves laterally to compensate for the wheel run out so that a lateral position of the strip opening relative to the lead frame remains substantially constant when the rotatable wheel rotates.

18. The plating system of claim 17 wherein the wheel run out is up to about 0.030 inches.

19. The plating system of claim 1, wherein lateral motion of the rotatable wheel is directly coupled to the tracking mechanism to thereby maintain the selected portion of the workpiece in substantial alignment with the strip opening.

20. A plating system configured to plate a selected portion of a workpiece, comprising:

a tank configured to hold a plating solution;

a masking belt set defining a longitudinally-oriented strip opening having a width and a plurality of wheel engagement features;

a backing masking belt; and a rotatable wheel disposed at least partially within the tank and configured to controllably adjust the width of the longitudinally-oriented strip opening of the masking belt set, the rotatable wheel including a periphery having the backing masking belt extending along a portion thereof, the periphery having a plurality of masking-belt engagement features configured to engage with the plurality of wheel engagement features, the masking belt set and backing masking belt positioned so that the selected portion of workpiece is progressively exposed to the plating solution through the strip opening when advanced into the plating solution between the masking belt set and backing masking belt.

21. The plating system of claim 20 wherein the rotatable wheel comprises a first outer plate, a second outer plate, and a removable core positioned therebetween and having a thickness.

22. The plating system of claim 20 wherein the rotatable wheel comprises a first plate including a first portion of the plurality of masking-belt engagement features and a second plate including a second portion of the plurality of masking-belt engagement features, the first and second plates coupled to each other via one or more fastener assemblies configured to controllably adjust a spacing between the first and second plates.

23. The plating system of claim 22 wherein each of the one or more fastener assemblies are operably interconnected by a drive belt.

24. The plating system of claim 20 wherein the masking belt set comprises first and second masking belts laterally spaced to define the strip opening and each including a portion of the plurality of wheel engagement features.

25. The plating system of claim 20 wherein the masking belt set comprises a first masking belt having a first beveled edge and a second masking belt having a second beveled edge laterally spaced from the first beveled edge to define the strip opening, the first and second beveled edges being slanted away from each other.

26. The plating system of claim 20 wherein:

the plurality of wheel engagement features of the masking belt set comprise a plurality of longitudinally-extending teeth; and the plurality of masking-belt engagement features of the rotatable wheel comprise a plurality of circumferentially-extending teeth complementarily configured with the plurality of longitudinally-extending teeth.

27. The plating system of claim 20 wherein:

the plurality of wheel engagement features of the masking belt set comprise a plurality of guide holes; and the plurality of masking-belt engagement features of the rotatable wheel comprise a plurality of pins positioned to sequentially engage with the plurality of guide holes as the rotatable wheel rotates.

28. The plating system of claim 20 wherein a tracking mechanism comprises a rotatable tracking roller positioned and configured to engage with the plurality of masking-belt engagement features of the rotatable wheel.

29. The plating system of claim 20, further comprising a tracking mechanism configured to guide a lead frame into the plating solution and move the workpiece laterally responsive to lateral movement of the rotatable wheel so that the selected portion of the workpiece and the strip opening are maintained in substantially alignment during entry into the plating solution.

30. The plating system of claim 29 wherein the tracking mechanism is configured as a passive tracking mechanism that passively moves responsive to the lateral movement of the rotatable wheel.

31. The plating system of claim 29 wherein the tracking mechanism is configured as an active tracking mechanism that moves responsive to sensing the lateral movement of the rotatable wheel.

32. The plating system of claim 20, further comprising an actuator positioned and configured to bias the masking belt set toward the backing masking belt.

33. The plating system of claim 20 wherein the workpiece comprises a lead frame including a plurality of serially arranged parts, and further wherein each serially arranged part of the lead frame is sequentially exposed to the plating solution when each serially arranged part is sequentially advanced into the plating solution between the masking belt set and the backing masking belt.

34. The plating system of claim 20 wherein the workpiece is configured as a metallic strip.

35. The plating system of claim 20, further comprising a negatively charged cathode drum positioned to contact the workpiece.

36. The plating system of claim 20 wherein the rotatable wheel is a drive wheel operable to advance the lead frame between the first and second masking belts into the plating solution.

37. The plating system of claim 20 wherein the rotatable wheel is a drive wheel operable to advance the workpiece into the plating solution.

* * * * *